US008424140B2

(12) United States Patent
Bassett

(10) Patent No.: US 8,424,140 B2
(45) Date of Patent: Apr. 23, 2013

(54) APPARATUS AND METHOD FOR DEGLAZING

(76) Inventor: Edward A. Bassett, Dallas, TX (US)

( * ) Notice: Subject to any disclaimer, the term of this patent is extended or adjusted under 35 U.S.C. 154(b) by 196 days.

(21) Appl. No.: 13/114,815

(22) Filed: May 24, 2011

(65) Prior Publication Data

US 2011/0289694 A1 Dec. 1, 2011

Related U.S. Application Data

(60) Provisional application No. 61/348,094, filed on May 25, 2010.

(51) Int. Cl.
*B26B 11/00* (2006.01)

(52) U.S. Cl.
USPC ..... 7/158; 126/401

(58) Field of Classification Search ..... 7/158; 126/401, 126/226; 15/105; 30/123.3
See application file for complete search history.

(56) References Cited

U.S. PATENT DOCUMENTS

| | | | | |
|---|---|---|---|---|
| 2,629,433 | A * | 2/1953 | Scholl | 126/401 |
| 3,845,755 | A * | 11/1974 | Aske | 126/401 |
| 4,306,323 | A * | 12/1981 | Poore | 7/105 |
| 5,313,931 | A * | 5/1994 | Coulcher et al. | 126/401 |
| 2010/0212095 | A1 * | 8/2010 | Suen | 15/105 |
| 2010/0274236 | A1 * | 10/2010 | Krimsky | 606/21 |

* cited by examiner

*Primary Examiner* — David B Thomas

(57) ABSTRACT

Embodiments of the present disclosure provide a deglazing apparatus and method for use to remove glass from a frame. Embodiments further describe an apparatus with cutting, heating and prying capabilities and a method of use. Some embodiments include a deglazing apparatus carrying device to storage during portions of the glass removal process.

20 Claims, 9 Drawing Sheets

APPARATUS AND METHOD FOR DEGLAZING

CROSS-REFERENCE TO RELATED APPLICATION

This application claims the benefit of priority from U.S. Provisional Application No. 61/348,094 filed on May 25, 2010.

FIELD OF THE INVENTION

The invention relates generally to the field of deglazing equipment and methods. The invention further relates to the field of deglazing to remove glass from frames. The invention also relates to the field of installing, repairing, and/or replacing framed glass.

BACKGROUND

Glass deglazing is used in the repair and removal of framed glass in many circumstances, including commercial and residential buildings. Generally, deglazing refers to a process for removing a glass from a frame by removing or separating the seal between the glass and frame and prying the glass from the frame. Common deglazing methods utilize a number of different devices to remove glass from a frame. For example, a person may use a pry bar, putty knife, razor, and propane torch to remove the glass from a frame. In addition, a person may use a handling device, such as suction cups, to handle the glass during deglazing and removal.

SUMMARY

Organizing, carrying, and switching tools during the removal and reinstallation process can be cumbersome and potentially dangerous due to the number of sharp edges and the flammable nature of propane. In addition to the tools for removing the glass, a person may also be carrying additional tools needed for the installation of the repaired or replacement glass. All of these concerns are increased when a person is working in a confined or limited environment, such as at the top of a ladder.

The present invention solves these and other problems associated with glass repair and removal.

Accordingly, an object of the disclosure is to provide an apparatus and method to improve glass repair and removal.

Another object of the disclosure is to provide an apparatus and method to increase safety during glass repair and removal.

Another object of the disclosure is to provide an apparatus and method that utilizes fewer tools.

Another object of the disclosure is to provide an apparatus that consolidates deglazing tools.

Another object of the disclosure is to provide an apparatus that is operable for multiple functions during deglazing.

Additional aspects, advantages and features of the present invention are included in the following description of exemplary examples thereof, which description should be taken in conjunction with the accompanying figures, wherein like numerals are used to describe the same feature throughout the figures.

A BRIEF DESCRIPTION OF THE DRAWINGS

DETAILED DESCRIPTION

Figure 1:
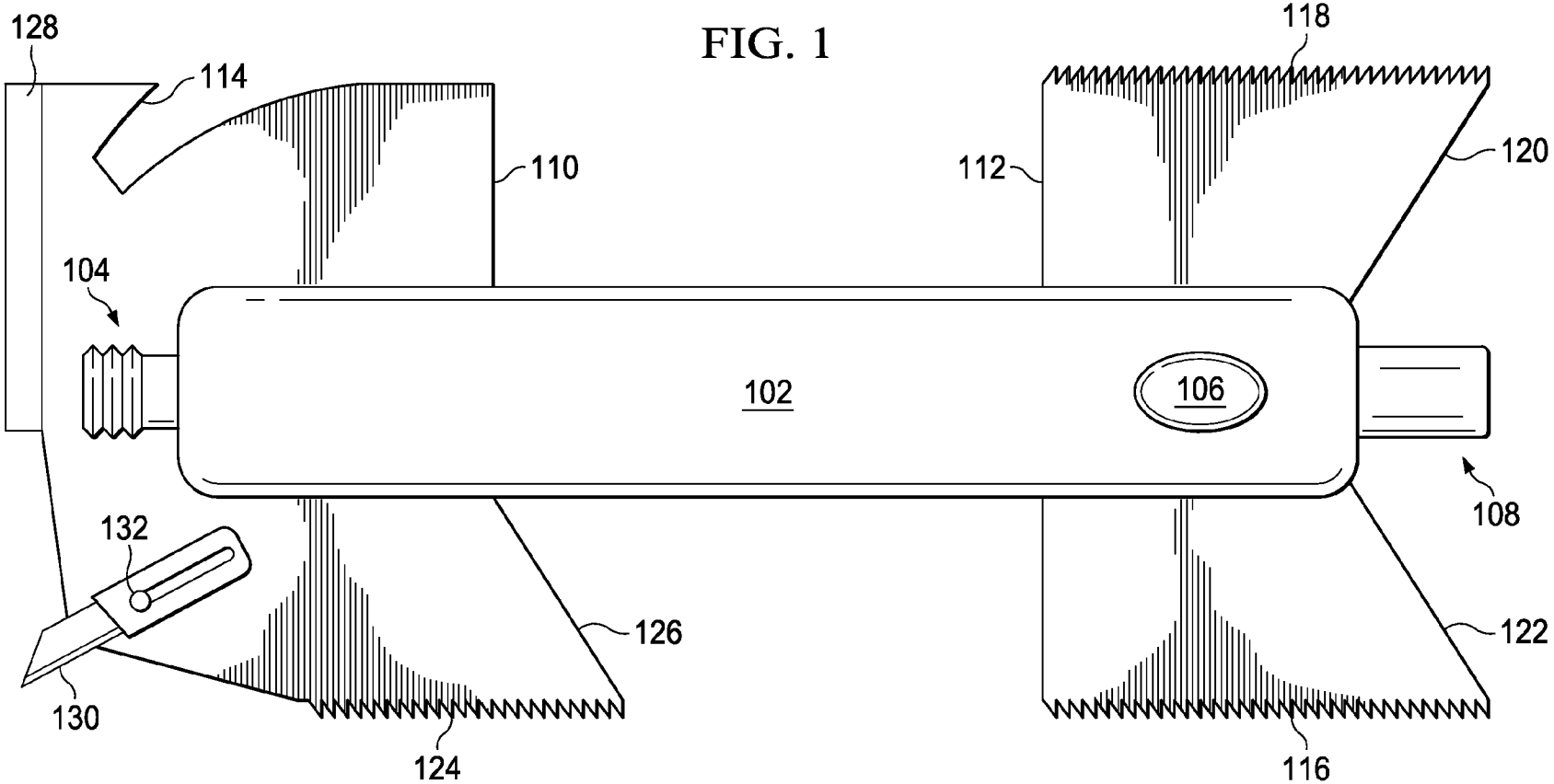
FIG. 1 is a top view of an embodiment of the apparatus.
Figure 2:
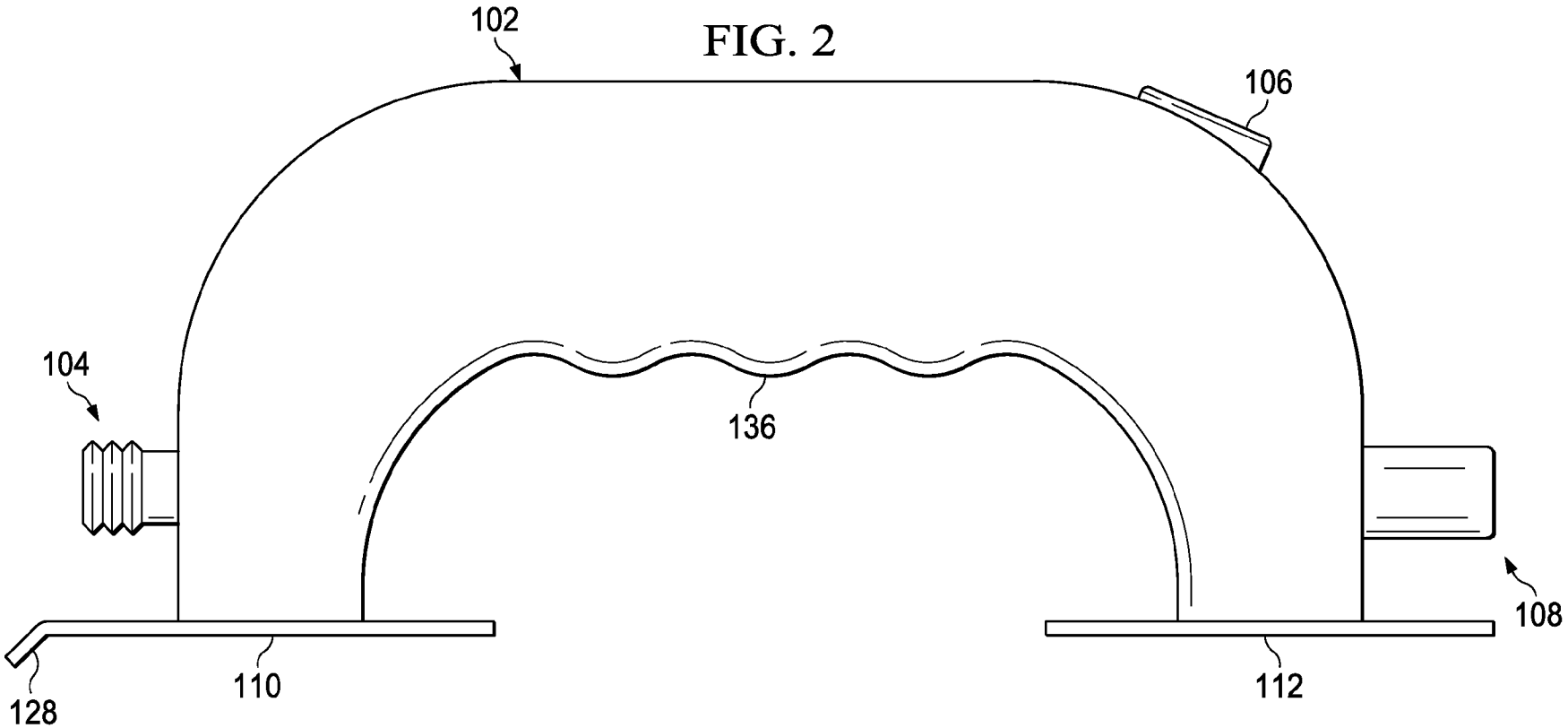
FIG. 2 is a side view of an embodiment of the apparatus.

FIGS. 1 and 2 illustrate a first exemplary embodiment of a deglazing apparatus. FIG. 1 depicts a top view of the first exemplary embodiment of the deglazing apparatus. The apparatus has handle 102 attached to back plate 110 and front plate 112. In this embodiment, handle 102 is depicted with gas output 104, gas control 106, and gas input 108. Handle 102 may store a combustible gas in a gas sealable chamber constructed in handle 102 or in a separate gas sealable container contained within handle 102. Although this disclosure refers to propane as the gas stored in handle 102, one of skill in the art will recognize that any combustible gas or combustible combination of gasses that meets the performance needs and limitations for deglazing may be utilized. For example, some gases may not meet a preferred temperature range for deglazing and some gases may increase the chances of damaging the frame and/or the glass.

The gas storage component in handle 102 is in operable association with gas output 104, gas control 106, and gas input 108. Gas output 104 is illustrated as a nozzle to direct the output gas flow. Gas control 106 is depicted as a button on the top of handle 102 and is associated with a gas flow control mechanism (not shown) within handle 102. In this embodiment, when gas control 106 is depressed the gas flow control mechanism (not shown) allows the flow of gas to travel from the gas storage component to gas output 104, and when gas control 106 is not depressed the gas flow control mechanism (not shown) prevents the flow of gas. In this embodiment, gas control 106 operates an igniter (not shown) associated with gas output 104 to light the gas flow, such that gas output 104 operates as a torch head when gas control 106 is depressed. Gas input 108 is port which may be connectable to an external source of gas. Gas input 108 may be used to fill and refill the gas storage component.

In this embodiment, front plate 112 is shown as a wing shaped plate at the end of handle 102 having gas output 104. In addition, handle 102 is shown attached near the center of front plate 112. Cutting edges 116 and 118 are located along the sides of front plate 112 away from handle 102. Front edges 120 and 122 extend between where handle 102 connects to front plate 112 cutting edges 116 and 118. In this embodiment, front edge 120 is shown at a forward angle from the point at which handle 102 connects with front plate 112 towards cutting edge 118 making an obtuse angle between handle 102 and front edge 120. Likewise, front edge 122 is shown at a forward angle from the point at which handle 102 connects with front plate 112 towards cutting edge 116 making an obtuse angle between handle 102 and front edge 122. In a preferred embodiment, each angle between handle 102 and front edges 120 and 122 would be around perpendicular plus 45 degrees or 135 degrees from handle 102. One of skill in the art will recognize that any other plate designs may be used that fall within the scope and spirit of the invention.

In this embodiment, back plate 110 is shown at the end of handle 102 having gas input 108. In addition, handle 102 is shown attached near the center and front of back plate 110. In this embodiment, back plate 110 is shown with cutting notch 114 on one side and cutting edge 124 on the other side. Front edge 126 is shown at a forward angle from the point at which handle 102 connects towards cutting edge 124 making an obtuse angle between handle 102 and front edge 126. In addition, pry edge 128 is located on a portion of the back edge of back plate 110. Cutting blade 130 is depicted between pry edge 128 and cutting edge 124. In this embodiment cutting blade 130 is shown as a retractable blade for additional safety, wherein blade control 132 may be utilized to retract and/or extend cutting blade 130. One of skill in the art will recognize, cutting blade 130 may be attached in any number of manners which may or may not incorporate safety measures, including a fixed attachment, retractable attachment, rotatable attachment, and/or any other means of attachment.

Cutting edges 116, 118 and 124 are depicted for cutting in a forward direction. In other embodiments, the direction for each of cutting edges 116, 118 and 124 may vary. In addition, the number of cutting edges and the placement of cutting edges may vary in alternate embodiments.

FIG. 2 depicts a side view of the first exemplary embodiment of the deglazing apparatus. FIG. 2 shows handle 102 attached to back plate 110 and front plate 112, and with gas output 104, gas control 106, and gas input 108. In addition, handle 102 is depicted with grip portion 136, which may comprise an ergonomic design for comfort and ease of use. FIG. 2 also depicts a downward bend of pry edge 128. One of skill in the art will recognize that the angle and direction of the bend of pry edge 128 may vary. For example, the direction and angle of pry edge 128 may depend on the type of glass and type of frame for which an embodiment is designed.

During the process of removing glass from a frame for repair or replacement, the apparatus depicted in FIGS. 1 and 2 may be used for numerous functions. For example, pry edge 128 may be used to remove a vinyl glazing bead from the perimeter of a window frame and cutting notch 114 may be used to cut vinyl which is pulled from the window frame. Gas output 104 may be used as a torch to heat a glue bed between the window frame and the glass. If the glass cannot be removed at this point with pry edge 128, cutting edges 116, 118, and 124 may be used separately and/or in conjunction with the torch at gas output 104 to cut the glass from the window frame at any areas where the glass remains stuck to the frame. Cutting blade 130 may be used as needed for any additional cutting which may be necessary and/or useful. Once the glass is not adhered to the window frame, pry edge 128 may be employed to pry the glass from the window frame.

Figure 3:
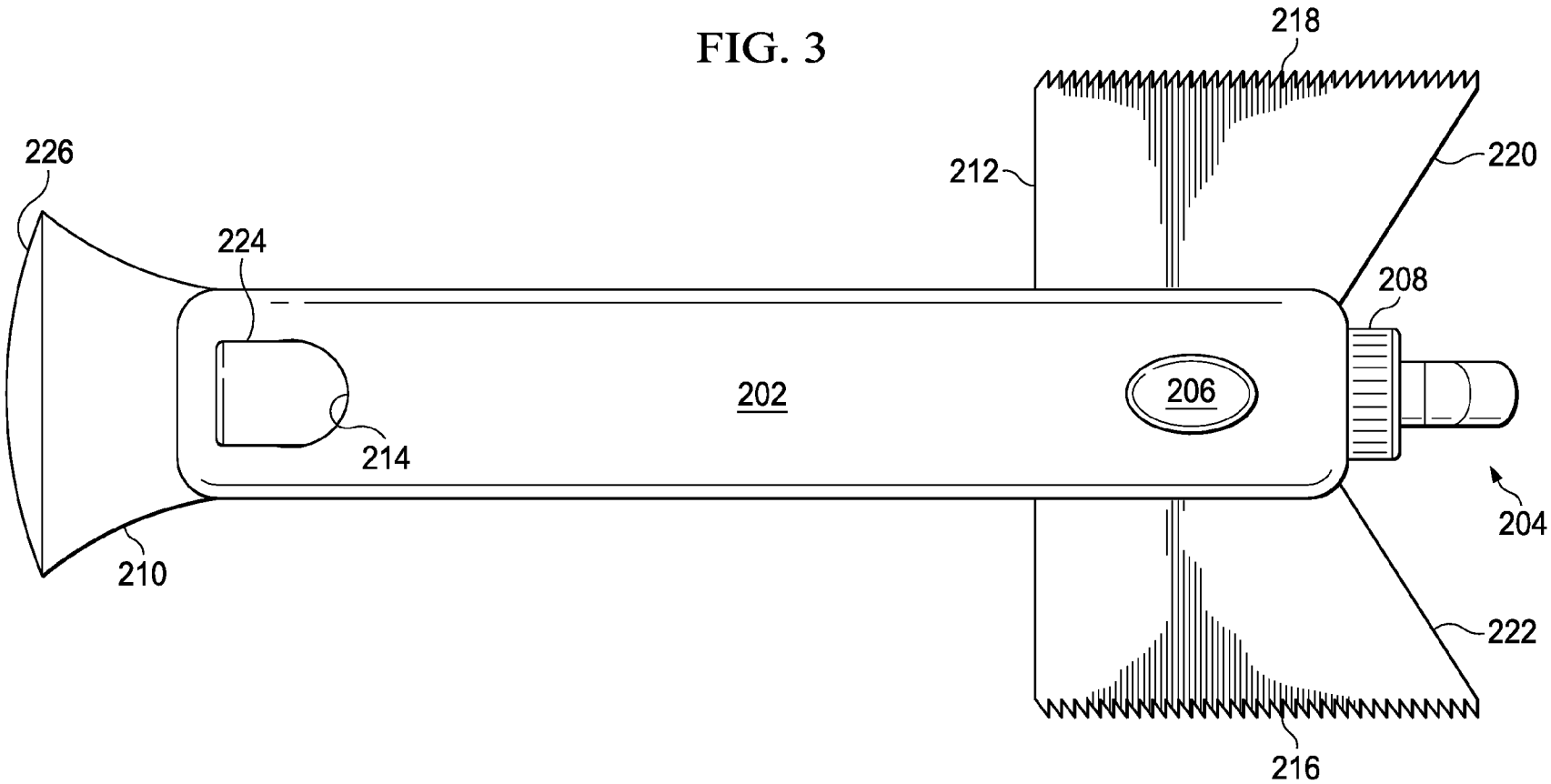
FIG. 3 is a top view of a second embodiment of the apparatus.
Figure 4:
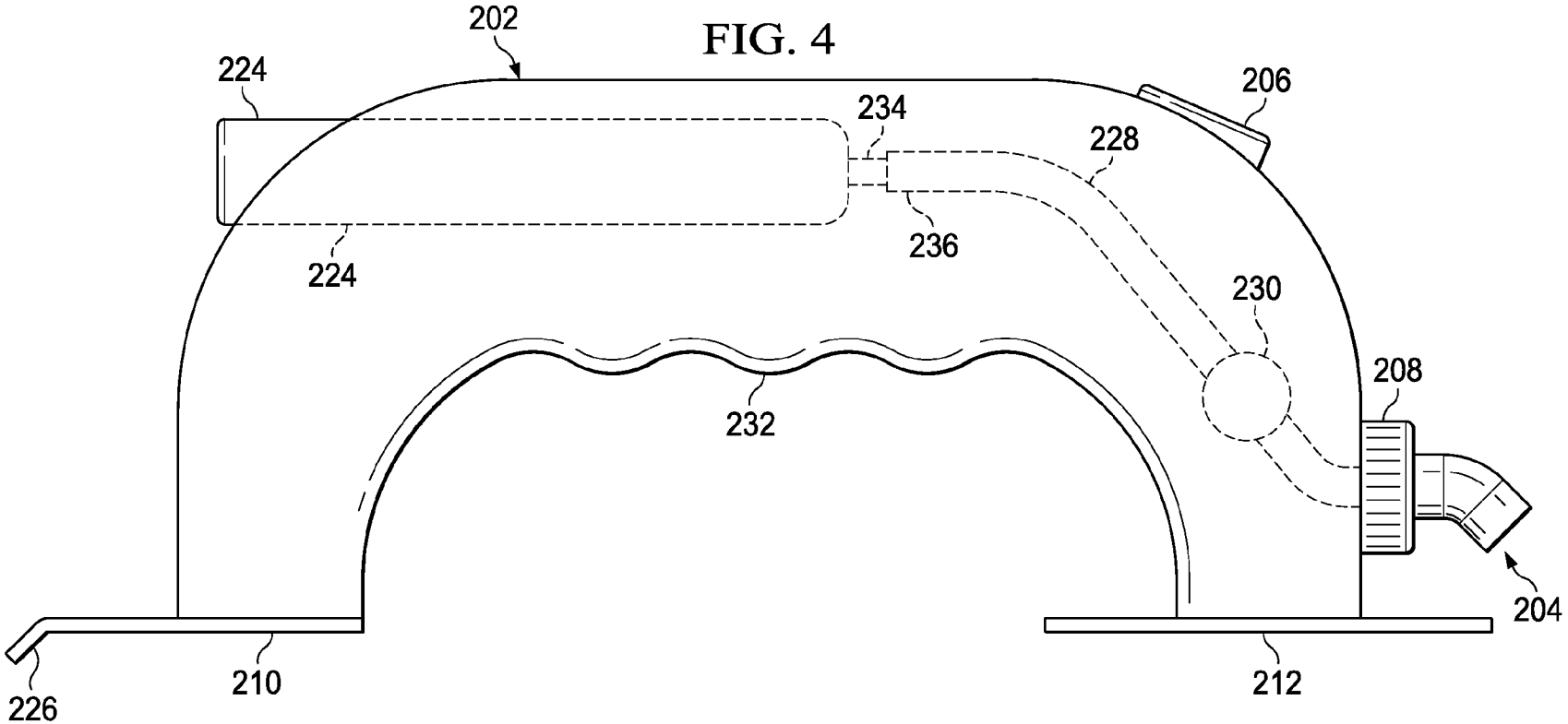
FIG. 4 is a side view of a second embodiment of the apparatus.

FIGS. 3 and 4 illustrate a second exemplary embodiment of a deglazing apparatus. FIG. 3 depicts a top view of the second embodiment of the deglazing apparatus. This embodiment has handle 202 attached to back plate 210 and front plate 212. Handle 202 is depicted with gas output nozzle 204, gas control 206, and gas nozzle adjustment 208. Handle 202 has cavity 214 constructed in handle 202 for removable gas container 224.

Removable gas container 224 is in operable association with gas output nozzle 204, gas control 206, and gas nozzle adjustment 208. As discussed for the first embodiment, gas output nozzle 204 directs the output gas flow and gas control 206 is depicted as a button on the top of handle 202. In addition, gas control 206 operates an igniter (not shown) associated with gas output nozzle 204 to light the gas flow and create a torch when gas control 206 is depressed. Gas nozzle adjustment 208 may be used to restrict or expand gas output nozzle 204 to control gas flow through gas output nozzle 204. In some embodiments, gas nozzle adjustment 208 may be used to adjust the direction in which gas output nozzle 204 is pointed. For example, gas output nozzle 204 may be pulled away from first plate 212 to be more parallel than gas output nozzle 204 is currently shown.

In this embodiment, like the first embodiment, front plate 212 is shown as a wing shaped plate attached to handle 202 near the center of front plate 212 at the end of handle 202 having gas output nozzle 204. Cutting edges 216 and 218 are located along the sides of front plate 212 away from handle 202. Front edges 220 and 222 extend between where handle 202 connects to front plate 212 to cutting edges 216 and 218. Front edge 220 is shown at a forward angle from the point at which handle 202 connects with front plate 212 towards cutting edge 218 making an obtuse angle between handle 202 and front edge 220. Likewise, front edge 222 is shown at a forward angle from the point at which handle 202 connects with front plate 212 towards cutting edge 216 making an obtuse angle between handle 202 and front edge 222. Like the first embodiment, cutting edges 216 and 218 are depicted for cutting in a forward direction.

In this embodiment, back plate 210 is shown at the end of handle 202 having cavity 214. In addition, handle 202 is shown attached near the center and front of back plate 210. In this embodiment, back plate 210 is shown with pry edge 226 located across the back edge of back plate 210.

FIG. 4 depicts a side view of the second exemplary embodiment of the deglazing apparatus. FIG. 4 shows handle 202 attached to back plate 210 and front plate 212, and with gas output nozzle 204, gas control 206, and gas nozzle adjustment 208. FIG. 4 depicts removable gas container 224 with output end 234 connected to input end 236 of gas tube 228. One of skill in the art will recognize that any form of connection permitting gas flow from removable gas container 224 into gas tube 228 may be utilized, including a threaded connection, a friction connection, a pressure connection, or a fitted connection. One of skill in the art will also recognize that removable gas container 224 may be any gas sealable container that may in removable connection with cavity 214 and gas tube 228. For example, removable gas container 224 may be a portable propane gas cartridge that is refillable and quickly interchangeable. Gas tube 228 directs gas flow to gas flow control mechanism 230. In this embodiment, when gas control 206 is depressed gas flow control mechanism 230 allows the flow of gas to travel from removable gas container 224 to gas output nozzle 204, and when gas control 206 is not depressed the gas flow control mechanism 230 prevents the flow of gas. One of skill in the art will recognize that any mechanism that may control gas flow may be implemented, including a variety of valves. In addition, handle 202 is depicted with grip portion 236, which may comprise an ergonomic design for comfort and ease of use. FIG. 4 also depicts a downward bend of pry edge 226.

During the process of removing glass from a frame for repair or replacement, the apparatus depicted in FIGS. 3 and 4 may also be used for numerous functions. For example, pry edge 226 may be used to remove a vinyl glazing bead from the perimeter of a window frame and cutting edge 216 may be used to cut vinyl which is pulled from the window frame. Gas output nozzle 204 may be used as a torch to heat a glue bed between the window frame and the glass. If the glass cannot be removed at this point with pry edge 226, cutting edges 216 and 218 may be used separately and/or in conjunction with the torch at gas output nozzle 204 to cut the glass from the window frame at any areas where the glass remains stuck to the frame. Once the glass is not adhered to the window frame, pry edge 226 may be employed to pry the glass from the window frame. In addition, a user may carry multiple removable gas containers 224 in case one runs out of gas during the process of removing glass.

Figure 5:
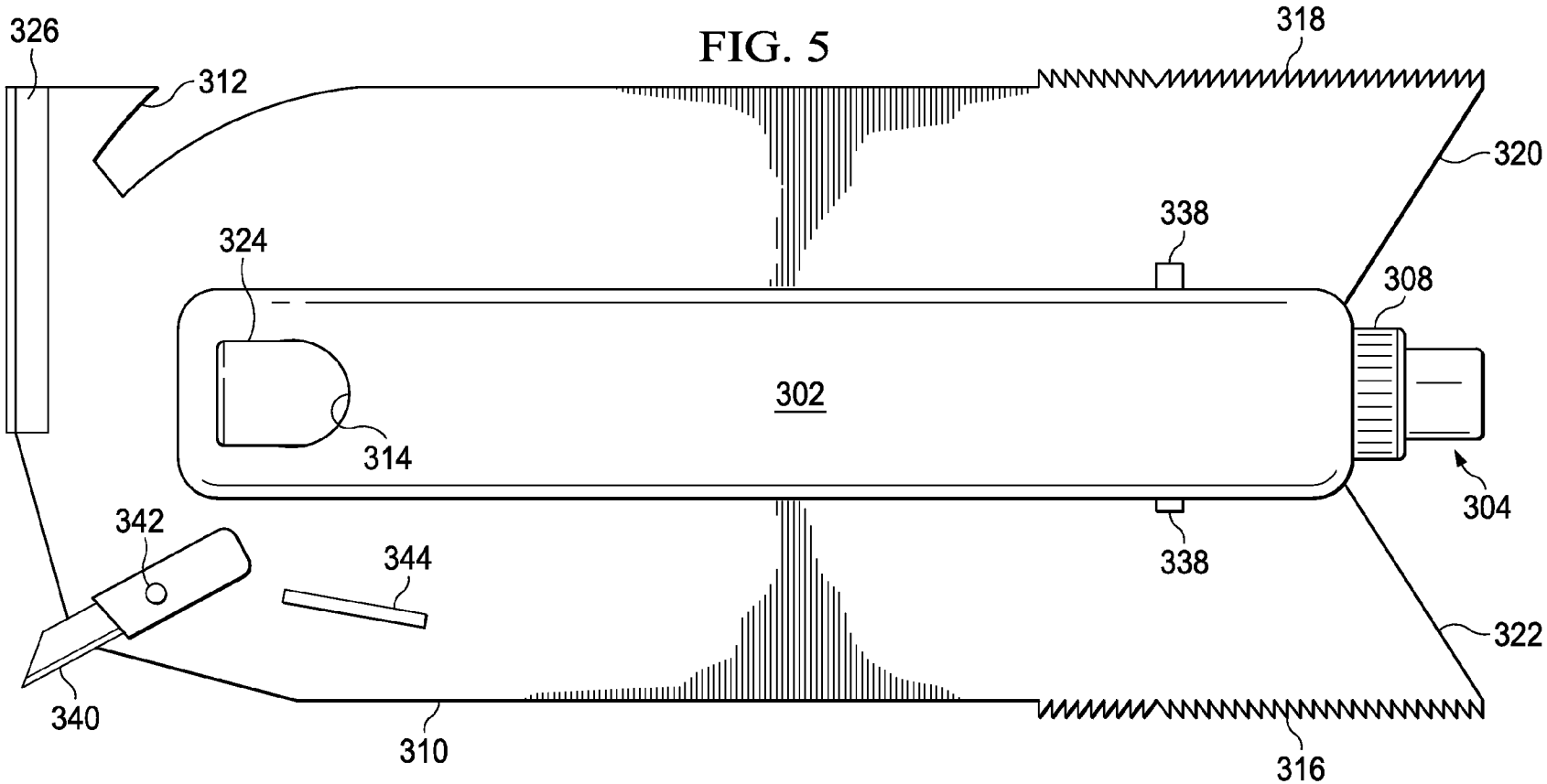
FIG. 5 is a top view of a third embodiment of the apparatus.
Figure 6:
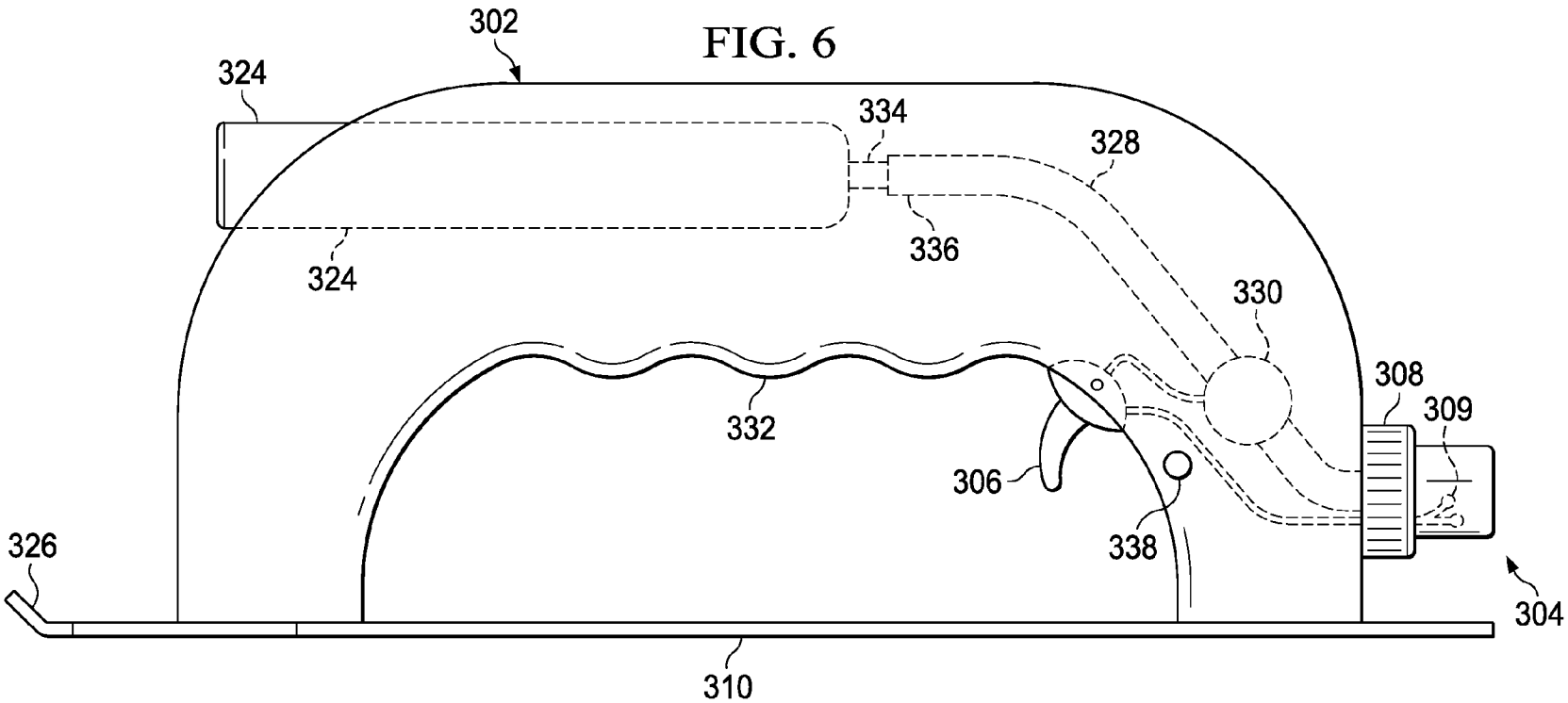
FIG. 6 is a side view of a third embodiment of the apparatus.

FIGS. 5 and 6 illustrate a third exemplary embodiment of a deglazing apparatus. FIG. 5 depicts a top view of the third embodiment of the deglazing apparatus. This embodiment has handle 302 attached to plate 310. Handle 302 is depicted with gas output nozzle 304 and gas nozzle adjustment 308. Handle 302 has cavity 314 constructed in handle 302 for removable gas container 324. Removable gas container 324 is in operable association with gas output nozzle 304 and gas nozzle adjustment 308. As discussed for the previous embodiment, gas output nozzle 304 directs the output gas flow and gas nozzle adjustment 308 may be used to restrict or expand gas output nozzle 304 to control gas flow through gas output nozzle 304.

In this embodiment, plate 310 is shown attached to handle 302 near the center of plate 310 with a wing shaped front near gas output nozzle 304. Cutting edges 316 and 318 are located along the front sides of plate 310 away from handle 302. Front edges 320 and 322 extend between where handle 302 connects to plate 310 to cutting edges 316 and 318. Front edge 320 is shown at a forward angle from the point at which handle 302 connects with front plate 312 towards cutting edge 318 making an obtuse angle between handle 302 and front edge 320. Likewise, front edge 322 is shown at a forward angle from the point at which handle 302 connects with front plate 312 towards cutting edge 316 making an obtuse angle between handle 302 and front edge 322. In this embodiment, the front sections of cutting edges 316 and 318 are depicted for cutting in a forward direction and back sections of cutting edges 316 and 318 are depicted for cutting in a backward direction.

In this embodiment, pry edge 326 located across the back edge of plate 310 at the end of handle 302 having cavity 314. Plate 310 is shown with cutting notch 312 on one side and cutting blade 340 on the other side away from handle 302. In this embodiment cutting blade 340 is shown as a rotatable blade for additional safety, wherein cutting blade 340 rotates around pivot point 342 between at least an open position (as shown) and a closed position. In a closed position, cutting blade 340 is placed in association with safety bar 344. When cutting blade 340 is in association with safety bar 344, the risk of accident caused by cutting blade 340 is reduced.

In addition, slide lock 338 is shown in this embodiment in handle 302. In this embodiment, slide lock 338 is used as a safety lock for gas control 306 (see FIG. 6). For example, gas control 306 (see FIG. 6) may not operate if slide lock 338 is pushed towards cutting edge 318 (as depicted), and gas control 306 (see FIG. 6) may operate if slide lock 338 is pushed towards cutting edge 316. One of skill in the art will recognize that any safety device may be employed as an alternative or in conjunction with slide lock 338 to limit the risk of accidents and remain within the scope and spirit of the invention.

FIG. 6 depicts a side view of the third exemplary embodiment of the deglazing apparatus. FIG. 6 shows handle 302 attached to plate 310 and with gas output nozzle 304, gas control 306, and gas nozzle adjustment 308. Similar to the second embodiment, handle 302 is depicted with grip portion 332, which may comprise an ergonomic design for comfort and ease of use. In addition, FIG. 6 depicts removable gas container 324 with output end 334 connected to input end 336 of gas tube 328. Gas tube 328 directs gas flow to gas flow control mechanism 330. In this embodiment, gas control 306 is depicted as a trigger mechanism on the bottom of handle 302 in front of grip portion 332. When gas control 306 is pulled gas flow control mechanism 330 allows the flow of gas to travel from the removable gas container 324 to gas output 304, and when gas control 306 is not pulled gas flow control mechanism 330 prevents the flow of gas. In addition, gas control 306 operates igniter 309 associated with gas output nozzle 304 to light the gas flow and create a torch when gas control 306 is pulled. Igniter 309 is depicted as a pronged electric igniter associated with gas output nozzle 304. One skilled in the art will recognize that any igniter may be used and remain within the scope and spirit of the invention. Slide lock 338 may operate to either allow or prevent gas flow output in any variety of ways. For example, slide lock 338 may be associated with gas control 306 to allow or prevent gas control 306 from being pulled, thus preventing gas flow control mechanism 330 from opening to allow a gas flow output. For another example, slide lock 338 may be associated with gas flow control mechanism 330 to allow or prevent a change in gas flow control mechanism 330, thus preventing gas flow control mechanism 330 from opening to allow a gas flow output despite gas control 306 being pulled. FIG. 6 also depicts an upward bend of pry edge 326.

During the process of removing glass from a frame for repair or replacement, the apparatus depicted in FIGS. 5 and 6 may also be used for numerous functions. For example, pry edge 326 may be used to remove a vinyl glazing bead from the perimeter of a window frame and cutting notch 312 may be used to cut vinyl which is pulled from the window frame. Gas output nozzle 304 may be used as a torch to heat a glue bed between the window frame and the glass. If the glass cannot be removed at this point with pry edge 326, cutting edges 316 and 318 may be used separately and/or in conjunction with the torch at gas output nozzle 304 to cut the glass from the window frame at any areas where the glass remains stuck to the frame. In addition, cutting blade 130 may be rotated into an open position (as shown) and used as needed for any additional cutting which may be necessary and/or useful. Once the glass is not adhered to the window frame, pry edge 326 may be employed to pry the glass from the window frame.

Figure 7:
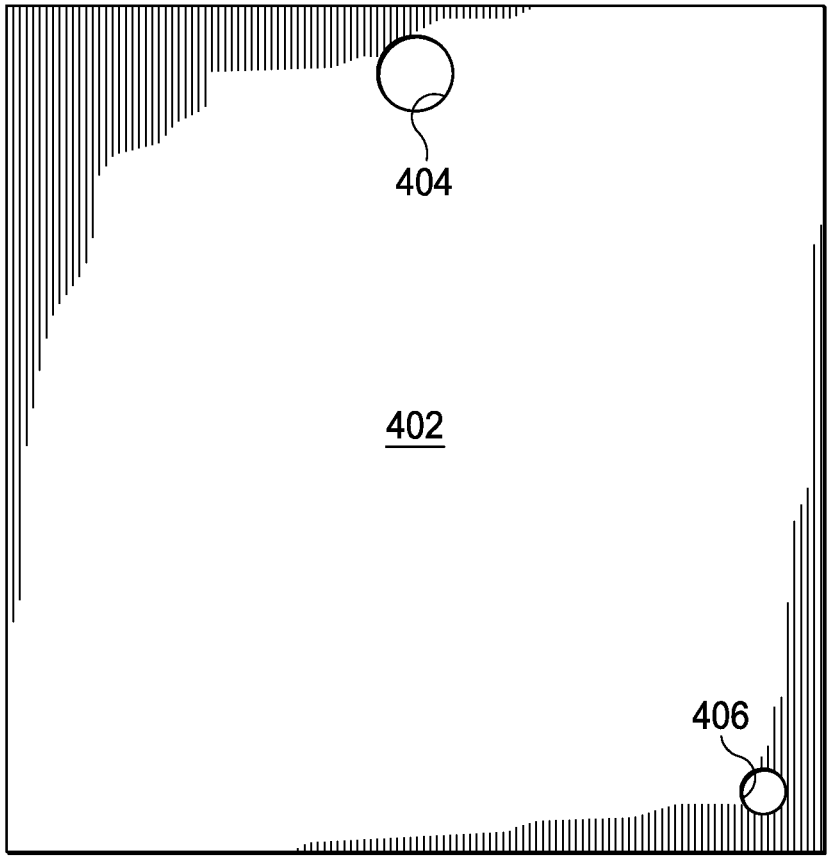
FIG. 7 is a top view of a securing device associated with the apparatus.

FIG. 7 depicts a user carrying device for a deglazing apparatus. Apparatus carrying plate 402 is shown as a flat magnetic plate with user connection 404 and tool carrier attachment 406. User connection 404 may be any mechanism or construction that provided capability to attach apparatus carrying plate to a user or a structure associate with a user, such as a ladder. For example, user connection 404 is shown as a hole which may be attached to a user's belt or a hook on a ladder. Tool carrier attachment 406 may be any mechanism which provides the capability to attach additional tools to apparatus carrying plate 402. For example, tool carrier attachment 406 is shown as a hole which may be used to attach suction cups used to hold panes of glass during removal and installation via hooks on the suction cups. A user of a deglazing apparatus having a metal portion may place the metal portion in magnetic association with apparatus carrying plate 402 such that a deglazing apparatus stays in association with apparatus carrying plate 402 until a user removes the apparatus from the magnetic association. For example, if front plate 112 of the first embodiment of a deglazing apparatus shown in FIG. 1 is metal, a user may place front plate 112 against apparatus carrying plate 402 to hold the apparatus shown in FIG. 1 while the user applies suction cups to the glass.

Figure 8:
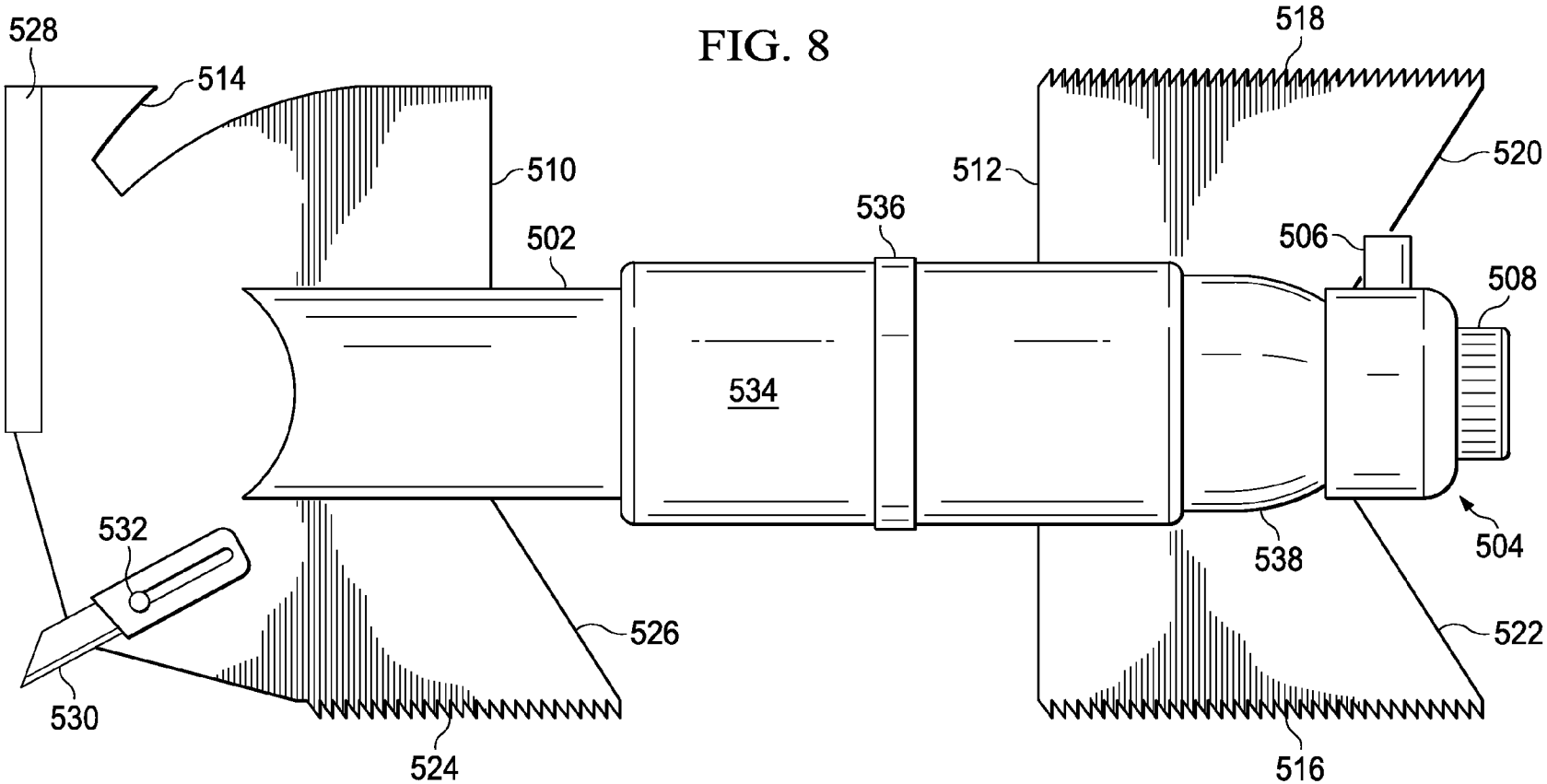
FIG. 8 is a top view of a fourth embodiment of the apparatus.
Figure 9:
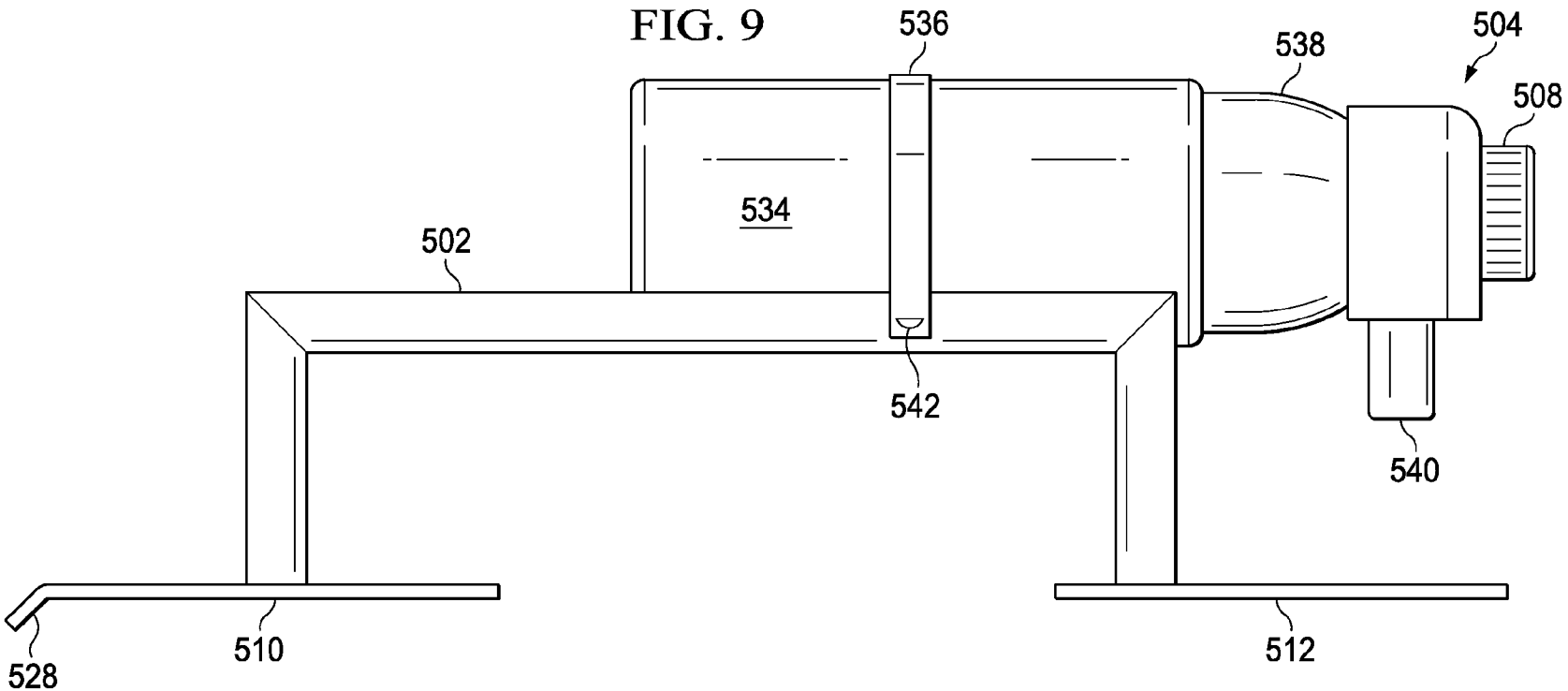
FIG. 9 is a side view of a fourth embodiment of the apparatus.

FIGS. 8 and 9 illustrate a fourth exemplary embodiment of a deglazing apparatus. FIG. 8 depicts a top view of the fourth embodiment of the deglazing apparatus. This embodiment has handle 502 attached to back plate 510 and front plate 512. On top of handle 502 is removable gas container 534 removably attached to handle 502 by strap 536. One skilled in the art will recognize that other means of removably or permanently attaching gas tank 534 to handle 502 may be used and remain within the scope and spirit of the disclosure. Gas tank 534 has a tapered front 538 which attaches to gas control cap 504. Gas control cap 504 includes gas output nozzle 540 (shown in FIG. 9), gas control 506, and gas nozzle adjustment 508. Handle 202 has a concave top for removable gas container 534 to sit in while attached.

Removable gas container 534 is in operable association with gas output nozzle 540, gas control 506, and gas nozzle adjustment 508 via gas control cap 504. As discussed for the first embodiment, gas output nozzle 540 directs the output gas flow and gas control 506 is depicted as a button on the side of gas control cap 504. In addition, gas control 506 operates an igniter (not shown) associated with gas output nozzle 540 to light the gas flow and create a torch when gas control 506 is depressed. Gas nozzle adjustment 508, depicted as a knob on gas control cap 504, may be used to control gas flow through gas output nozzle 540.

In this embodiment, like the first embodiment, front plate 512 is shown as a wing shaped plate attached to handle 502 near the center of front plate 512 at the end of handle 502 having gas control cap 504. Cutting edges 516 and 518 are located along the sides of front plate 512 away from handle 502. Front edges 520 and 522 extend between where handle 502 connects to front plate 512 to cutting edges 516 and 518. Front edge 520 is shown at a forward angle from the point at which handle 502 connects with front plate 512 towards cutting edge 518 making an obtuse angle between handle 502 and front edge 520. Likewise, front edge 522 is shown at a forward angle from the point at which handle 502 connects with front plate 512 towards cutting edge 516 making an obtuse angle between handle 502 and front edge 522. Like the first embodiment, cutting edges 516 and 518 are depicted for cutting in a forward direction.

In this embodiment, like the first embodiment, back plate 510 is shown at the end of handle 502 opposite from gas control cap 504. Handle 502 is shown attached near the center and front of back plate 510. In this embodiment, back plate 510 is shown with cutting notch 514 on one side and cutting edge 524 on the other side. Front edge 526 is shown at a forward angle from the point at which handle 502 connects towards cutting edge 524 making an obtuse angle between handle 502 and front edge 526. In addition, pry edge 528 is located on a portion of the back edge of back plate 510. Cutting blade 530 is depicted between pry edge 528 and cutting edge 524. In this embodiment cutting blade 530 is shown as a retractable blade for additional safety, wherein blade control 532 may be utilized to retract and/or extend cutting blade 530. Like the first embodiment, cutting edges 516, 518 and 524 are depicted for cutting in a forward direction.

FIG. 9 depicts a side view of the fourth exemplary embodiment of the deglazing apparatus. FIG. 9 shows handle 502 attached to back plate 510 and front plate 512. FIG. 9 depicts removable gas container 534 with tapered front 538 attached to gas control cap 504 having gas output nozzle 540, gas control 506, and gas nozzle adjustment 508. One of skill in the art will recognize that any form of connection permitting gas flow from removable gas container 534 into gas control cap 504 may be utilized, including a threaded connection, a friction connection, a pressure connection, or a fitted connection. In addition, handle 502 is depicted with concave design in which removable gas container 534 may rest. One of skill in the art will recognize that handle 502 may also comprise an ergonomic design for further comfort and ease of use. Removable gas container 534 is shown attached to handle 502 by strap 536. Strap 536 may be placed around removable gas container 534 and attached to handle 502 by attachment mechanism 542. One skilled in the art will recognize that attachment mechanism 542 may be a threaded connection, a friction connection, a pressure connection, a fitted connection or any other connection allowing strap 536 to secure removable container 534 to handle 502. FIG. 9 also depicts a downward bend of pry edge 226.

During the process of removing glass from a frame for repair or replacement, the apparatus depicted in FIGS. 8 and 9 may be used for numerous functions. For example, pry edge 528 may be used to remove a vinyl glazing bead from the perimeter of a window frame and cutting notch 514 may be used to cut vinyl which is pulled from the window frame. Gas output nozzle 540 may be used as a torch to heat a glue bed between the window frame and the glass. If the glass cannot be removed at this point with pry edge 528, cutting edges 516, 518, and 524 may be used separately and/or in conjunction with the torch at gas output nozzle 540 to cut the glass from the window frame at any areas where the glass remains stuck to the frame. Cutting blade 530 may be used as needed for any additional cutting which may be necessary and/or useful. Once the glass is not adhered to the window frame, pry edge 528 may be employed to pry the glass from the window frame.

The invention being thus described, it will be obvious that the same may be varied in many ways. Such variations are not to be regarded as a departure from the spirit and scope of the invention and all such modifications as would be obvious to one skilled in the art are intended to be included within the scope of the system or method described.

What is claimed:

1. A deglazing apparatus comprising:

a grip;

a cutting edge attached to said grip;

a prying edge attached to said grip;

a gas output attached to said grip; and a gas source in operable association with said gas output.

2. The deglazing apparatus according to claim 1, said grip further comprising a first end and a second end, wherein said gas output is attached to said first end of said grip and said cutting edge is attached to said first end of said grip.

3. The deglazing apparatus according to claim 2, said cutting edge comprising a first cutting edge and a second cutting edge.

4. The deglazing apparatus according to claim 3, further comprising a plate attached to said first end of said grip, wherein said plate further comprises said first cutting edge and said second cutting edge.

5. The deglazing apparatus according to claim 4, said plate comprising:

a wing shape comprising a back edge, a first side edge, a second side edge, a first front edge and a second front edge, wherein said first front edge is adjacent to said first side edge, said first side edge is adjacent to said back edge, said back edge is adjacent to said second side edge and said second side edge is adjacent to said second front edge, and wherein said first side edge comprises said first cutting edge and said second side edge comprises said second cutting edge.

6. The deglazing apparatus according to claim 5, wherein said first front edge and said first side edge create a first angle, wherein said first angle is in the range between 10 degrees and 90 degrees; and wherein said second front edge and said second side edge create a second angle, wherein said second angle is in the range between 10 degrees and 90 degrees.

7. The deglazing apparatus according to claim 2, wherein said prying edge is attached to said second end of said grip.

8. The deglazing apparatus according to claim 1, wherein said gas source is at least one of a sealable gas compartment within said grip and a removable gas tank.

9. The deglazing apparatus according to claim 8, said grip further comprising a gas input in operable association with said sealable gas compartment.

10. The deglazing apparatus according to claim 8, said grip further comprising a gas tank compartment, wherein said removable gas tank is at least partially within said gas tank compartment when said removable gas tank is in operable association with said gas output.

11. The deglazing apparatus according to claim 1, further comprising a gas flow control in operable association with said gas source and said gas output.

12. The deglazing apparatus according to claim 1, further comprising a plate attached to said grip, wherein said plate comprises said prying edge and said cutting edge.

13. The deglazing apparatus according to claim 1, further comprising:

a cutting plate attached to a first end of said grip comprising said cutting edge; and a prying plate attached to a second end of said grip comprising said prying edge.

14. The deglazing apparatus according to claim 13, wherein said gas output is attached to said first end of said grip.

15. The deglazing apparatus according to claim 13, said prying plate further comprising at least one of a cutting notch and a cutting edge.

16. The deglazing apparatus according to claim 15, wherein said blade is movable between at least a first position and a second position, wherein said blade extends beyond an edge of said prying plate when in said first position and said blade.

17. The deglazing apparatus according to claim 13, further comprises a blade.

18. A method of removing glass from a frame comprising:

removing vinyl from a frame with a deglazing apparatus;

cutting said vinyl with an edge of said deglazing apparatus;

heating said glass with said deglazing apparatus; and removing said glass from said frame with said deglazing apparatus.

19. The method of claim 18, further comprising the step of cutting said glass from said frame with said deglazing apparatus.

20. The method of claim 18, further comprising the step of cutting said glass from said frame with said deglazing apparatus in conjunction with heating said glass.

* * * * *